US006513212B1

(12) United States Patent
Mooberry et al.

(10) Patent No.: US 6,513,212 B1
(45) Date of Patent: Feb. 4, 2003

(54) SCANNABLE PHOTOGRAPHIC ELEMENT CONTAINING HIGH EXTINCTION HIGH-DYE-YIELD CYAN COUPLERS

(75) Inventors: Jared B. Mooberry, Rochester, NY (US); Wojciech K. Slusarek, Rochester, NY (US); David T. Southby, Rochester, NY (US); David H. Levy, Rochester, NY (US); Xiqiang Yang, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/025,359

(22) Filed: Dec. 19, 2001

(51) Int. Cl.[7] ..... G03C 1/08; G03C 7/26; G03C 7/32

(52) U.S. Cl. ..... 26/1; 430/226; 430/359; 430/543; 430/559; 430/955; 430/958; 430/385

(58) Field of Search ..... 430/226, 359, 430/543, 559, 955, 958, 553, 385

(56) References Cited

U.S. PATENT DOCUMENTS

| | | | | | |
|---|---|---|---|---|---|
| 4,840,884 | A | | 6/1989 | Mooberry et al. | |
| 5,447,819 | A | * | 9/1995 | Mooberry et al. | 430/955 |
| 5,457,004 | A | | 10/1995 | Mooberry et al. | |
| 5,830,632 | A | * | 11/1998 | Chari et al. | 430/226 |
| 5,998,121 | A | * | 12/1999 | Southby et al. | 430/543 |
| 6,007,973 | A | * | 12/1999 | Southby et al. | 430/958 |
| 6,132,944 | A | | 10/2000 | Mooberry et al. | |

* cited by examiner

*Primary Examiner*—Geraldine Letscher
(74) *Attorney, Agent, or Firm*—Chris P. Konkol

(57) ABSTRACT

A color photographic element comprising at least three light-sensitive units which have their individual sensitivities in different wavelength regions, at least one of units comprising a light-sensitive silver-halide emulsion, binder, and a coupler represented by formula I:

$$\text{COUP—(T)}_m\text{—L—DYE'} \qquad \text{(I)}$$

wherein COUP is a coupler parent group capable of reacting with an oxidized developer to form a first cyan dye and is bonded at a coupling position to a releasable group that forms a second dye of the same hue, as described in the specification.

26 Claims, No Drawings

SCANNABLE PHOTOGRAPHIC ELEMENT CONTAINING HIGH EXTINCTION HIGH-DYE-YIELD CYAN COUPLERS

FIELD OF THE INVENTION

This invention relates to a scannable color photographic or photothermographic element containing a silver-halide emulsion layer and an associated high-dye-yield cyan coupler that releases a high extinction dye, for example methylene blue, in addition to the normal chromogenic dye during processing.

BACKGROUND OF THE INVENTION

U.S. Pat. No. 4,840,884 to Mooberry and Singer disclose high-dye-yield (HDY) couplers that react with oxidized color developer, typically in a conventional wet, alkaline, photographic process, to form one dye from the coupler parent and release a second dye or a precursor of a second dye, usually a high extinction methine dye. Coupler coating loads can be decreased and/or density increases can be achieved by the use of such HDY couplers compared to ordinary two equivalent couplers for a given silver laydown. U.S. Pat. No. 5,457,004 describes high dye yield couplers, especially yellow couplers, that have methine dye chromophores and sulfonamide-solubilized coupler moieties. Improved high-dye-yield (HDY) couplers have been disclosed by Mooberry et al. in U.S. Pat. No. 6,132,944. This patent discloses high-dye-yield couplers that contain a release dye bonded through an acyloxy type group at the coupling site where the coupler contains an arylhydroxy, sulfamoyl or sulfonamido group of pKa less than 8.8.

PROBLEM TO BE SOLVED BY THE INVENTION

There is a continuing need for a coupler that (a) enables formation of increased dye density in the photographic element; (b) enables an increase in contrast, leading to improved images through use of higher concentrations of image modifying compounds in the photographic element; and (c) enables lower concentrations of silver halide in the photographic element without lowering image quality. Moreover, the use of higher-density forming couplers allow the laydown of couplers to be minimized, which improves image resolution.

Higher density can be achieved by increased reactivity and by an increased extinction of the dye formed or released by the coupler.

Another problem, especially relevant to photothermographic systems, is achieving adequate dye density, especially for cyan and yellow dyes. Photothermographic systems involve heat processable photosensitive elements that are constructed so that after exposure, they can be processed in a substantially dry state by applying heat. Because of the much greater challenges involved in developing a dry or substantially dry color photothermographic system, however, most of the activity to date has been limited to black and white photothermographic systems, especially in the areas of health imaging and microfiche.

Finally, another problem in constructing light-sensitive imaging elements is forming cyan, yellow and magenta dye records of comparable density-forming ability and consistent stability in all three color records, which can be especially difficult in a photothermographic system. A major problem that remains in phototothermographic systems, wherein the dye images require the reaction of a blocked developer and a dye-forming coupler through substantially dry gelatin, is how to facilitate the speed and ease with which the various dye images may be formed. In order to solve this problem, there is a need for a photothermographic element containing a stable high-dye-yield coupler that will exhibit a higher reactivity with oxidized developer than couplers heretofore discovered and provide higher extinction dyes.

SUMMARY OF THE INVENTION

These and other problems may be overcome by the practice of our invention. Applicants have found certain cyan HDY couplers that are advantageous for light-sensitive color photographic systems. In particular, Applicants have demonstrated that a class of cyan HDY couplers gives high dye densities with heat processing in the absence of base. More specifically, such couplers produce a second dye of high extinction coefficient such as methylene blue (extinction=100,000) in addition to the normal chromogenic dye (extinction about 30,000).

Preferably, the HDY couplers of the present invention form two dyes having a combined extinction that is greater than 1.5 times the extinction of the dye formed by the coupler alone.

The invention is especially useful for films intended for scanning or for use in color photothermographic films. First, achieving higher dye density is a greater problem in color photothermographic systems as explained above. Second, more variation in hue can be tolerated in a scan-only film.

In one embodiment, the HDY coupler is used to produce a cyan hue, for example, by releasing methylene blue or a similar dye. Methylene blue releasing HDY couplers can be readily synthesized from commercially available methylene blue by reduction, phosgenation, and attachment to appropriate coupler intermediates. In one embodiment, it has been found advantageous to use such an HDY cyan coupler in the cyan record of a photothermographic element, in association with a blocked para-phenylene diamine developer.

The invention is also directed to a photothermographic element containing a light sensitive silver halide emulsion layer having associated therewith a coupler represented by Formula I. The invention is also directed to a method of making HDY couplers according to the present invention.

The present invention requires coating at least one surface of a substrate with at least one compound represented by the following formula:

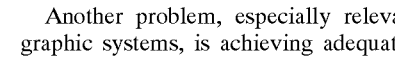

$$\text{COUP—(T)}_m\text{—L—DYE'} \qquad \text{(I)}$$

Wherein

COUP is a photographic coupler residue capable of coupling with oxidized color developer to form a first cyan dye;

T is a timing group;

m is an integer from 0 to 2, preferably 0 or 1;

L is a linking group selected from the group consisting of —OC(=O)—, —OC(=S)—, —SC(=O)—, and —SC(=S)— and wherein DYE' is a group that, upon release from the coupling site in COUP, forms a second dye (a "DYE compound") or dye precursor ("P-DYE") such as a leuco dye that is then converted to a second dye, which second dye is the same color (cyan) as the first dye. The coupler COUP is linked, at the coupling site, through an optional timing group and a linking group (preferably OC═O) to a nitrogen atom in the DYE' group. In one embodiment, DYE' is represented by the following formula:

(II)

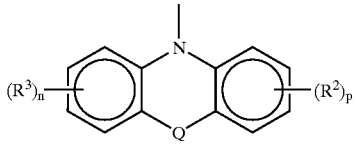

wherein $R^2$ and $R^3$ are independently selected organic or inorganic substituents selected to obtain a cyan hue in the DYE compound, which DYE compound absorbs predominantly in the 600 to 700 nm range. Preferably, $R^2$ and $R^3$ are C1 to C10 (has 1 to 10 carbon atoms) organic subsituents, more prefereably independently selected from the group consisting of substituted or unsubstituted alkyl, aryl, alkoxy, hydroxy, amino, alkylamino, dialkylamino, and acetamido groups, preferably having 1 to 10 carbon atoms, more preferably 1–6 carbon atoms; and wherein a plurality of organic $R^2$ or a plurality of organic $R^3$ groups can form a saturated, unsaturated, or aromatic ring, including carbocylic and heterocylic rings (preferably C1 to C10 rings). Preferably n and p are both 1 and $R^2$ and $R^3$ are para to the nitrogen in Structure II;

n and p are independently an integer from 0 to 4; and

Q is O, S, or NR' where R' is H or a substituted or unsubstituted alkyl or aryl group.

Finally, the invention also provides an imaging element and an imaging method. In one embodiment, a color photothermographic element is exposed to light and thereafter heating the element for development.

DETAILED DESCRIPTION OF THE INVENTION

One embodiment of the invention is directed to a chromogenic photothermographic element comprising radiation sensitive silver halide, a blocked developing agent, at least one cyan coupler that forms an image dye upon reaction of said compound with the oxidation product of the unblocked developing agent, a hydrophilic binder, wherein the cyan coupler provides improved density during image formation.

The color photothermographic element comprises a blocked developer that decomposes (i.e., unblocks) on thermal activation to release a developing agent that reacts to form a dye. This thermal activation is at a temperature of at least 60° C., preferably at least 80° C., more preferably at least 100° C. In dry processing embodiments, thermal activation preferably occurs at temperatures between about 80 to 180° C., preferably 100 to 160° C. In not-completely-dry development ("substantially dry") systems, thermal activation preferably occurs at temperatures between about 60 and 140° C. in the presence of added water, which is used in an amount that is insufficient to fully swell all the imaging layers. Preferably, any added water is neither highly acidic nor highly basic, with pH between 5 and 9. In one preferred embodiment of the invention, the photothermographic element comprises at least one organic silver salt (inclusive of complexes), acting as a silver donor.

The invention additionally relates to a method of image formation having the steps of: thermally developing an imagewise exposed photothermographic element having a blocked developer in association with a cyan coupler according to the present invention. The blocked developer decomposes on thermal activation to release a developing agent; the oxidized form of which reacts with the coupler to form a developed image. In one embodiment of the invention, a positive image can be formed by scanning the developed image to form a first electronic image representation (or "electronic record") from said developed image, digitizing said first electronic record to form a digital image, modifying said digital image to form a second electronic image representation, and storing, transmitting, printing or displaying said second electronic image representation.

The invention further relates to a one-time-use (OTUC) camera containing a light sensitive photothermographic element, which comprises a support on which is coated an imaging layer comprising a blocked developer and a cyan HDY coupler, which blocked developer decomposes to release a developing agent. The released developer reacts with the cyan coupler of the invention in the imaging layer of the element. The invention further relates to a method of image formation having the steps of imagewise exposing such a light sensitive photographic element in a one-time-use camera having a heater so as to process thermally the exposed element in the camera.

In one embodiment of the invention, a photographic element containing a light sensitive silver halide emulsion layer has associated therewith a coupler represented by Formula III.

III

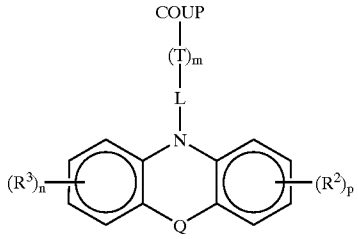

wherein

COUP is a photographic coupler residue capable of coupling with oxidized color developer to form a first cyan dye;

T is a timing group;

m is an integer from 0 to 2;

L is a linking group selected from the group consisting of —OC(═O)—, —OC(═S)—, —SC(═O)—, and —SC(═S)— wherein T (when m is not 0) or L (when m is 0), is attached to the coupling site of COUP; and $R^2$ and $R^3$ are independently selected organic or inorganic substituents, preferably independently selected from the group consisting of substituted or unsubstituted alkyl, aryl, alkoxy, hydroxy, amino, alkylamino, dialkylamino, and acetamido groups, preferably having 1 to 10 carbon atoms, more preferably 1–6 carbon atoms; and wherein a plurality of $R^2$ and $R^3$ groups can form a saturated, unsaturated, or aromatic ring, including carbocylic and heterocylic rings;

n and p are independently an integer from 0 to 4, preferably both 1 or 2; and

Q is O, S, or NR' where R' is H or a substituted or unsubstituted alkyl or aryl group.

COUP of the invention is the parent portion of the coupler. This is the portion of the coupler that combines with oxidized color developer in a conventional process to form a colored image dye. The various types of parent couplers are described more fully hereinafter.

More specifically, L (or T, if present) is a group which serves to connect COUP, at the coupling site, to the attached form of the second dye. L has a formula so as to permit —L—DYE' or —$(T)_m$—L—DYE' to be cleaved (like a coupling-off group) from the coupler upon the coupler's oxidative coupling with color developer during development processing. COUP combines with the oxidized developer to form the first dye and the fragment —L—DYE' or —$(T)_m$—L—DYE' is then freed from COUP. Suitable groups for L are —OC(O)—, —OC(S)—, —SC(O)—, —SC(S). Such groups permit the cleavage of the fragment from COUP or a timing group, if present, and are cleaved from DYE' during processing. Such groups also serve to effect a shifting of the dye hue so that, while the coupler is intact in the photographic element, the coupler will not unduly interfere with the transmission of light through the element.

T is a timing group which, as indicated by the value range for m of from 0 to 2, may be absent or may represent one or two such timing groups. Such groups are well-known in the art such as (1) groups utilizing the cleavage reaction of a hemiacetal (U.S. Pat. No. 4,146,396, Japanese Applications 60-249148; 60-249149); (2) groups utilizing an electron transfer reaction along a conjugated system (U.S. Pat. Nos. 4,409,323; 4,421,845; Japanese Applications 57-188035; 58-98728; 58-209736; 58-209738); (3) groups utilizing the cleavage of imino ketals (U.S. Pat. No. 4,546,073); (4) groups that function as a coupler or reducing agent after the coupler reaction (U.S. Pat. Nos. 4,438,193; 4,618,571); and (5) groups using an intramolecular nucleophilic substitution reaction (U.S. Pat. No. 4,248,962). The timing group to which the L-DYE' group of the invention is optionally attached is any one which will permit release of the L-DYE' group. Foregoing group (5) is not suitable as the group to release L-DYE' but could serve as the first of a sequence of two timing groups. Other timing groups are generally suitable for releasing —L—DYE'. Timing groups as described under (2) and the listed patents are most suitable. Generally these consist of a bond from COUP or another timing group to an oxygen atom which is bonded to a substituted or unsubstituted aromatic hydrocarbyl or heterocyclic ring at a location in conjugation with a methyl group on the ring which may optionally be substituted with one or two alkyl groups, where the methyl group is bonded to L—DYE' or a second timing group.

One example of such a group containing an aromatic heterocycle is:

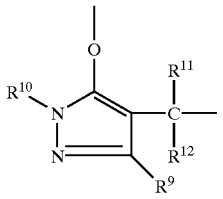

where $R^9$ through $R^{12}$ are independently hydrogen or substituents that do not adversely affect the coupling and release reactions or the properties of the dyes formed thereby.

A particularly useful timing group is represented by the formula:

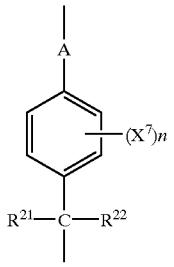

wherein A is attached to the coupler and the quaternary carbon at the other end of the timing group is attached to the L link and wherein:

A is O, S, or sulfonamido (N—$SO_2R^{23}$);

$R^{21}$ and $R^{22}$ are individually hydrogen, or substituted or unsubstituted alkyl, such as methyl, ethyl, propyl, n-butyl or t-butyl, or aryl, such as unsubstituted or substituted phenyl;

$X^7$ is a substituent that does not adversely affect the coupler; and n is 0, 1, 2, 3 or 4.

$R^{23}$ is a substituent, typically alkyl or aryl. Typically $R^{21}$ and $R^{22}$ are hydrogen. Typically, $X^7$ is an electron withdrawing or donating group, for example, alkyl, such as methyl, ethyl, propyl, n-butyl, t-butyl and eicosyl, halogen, such as chlorine and bromine, nitro, carbamyl, acylamido, sulfonamido, sulfamyl, sulfo, carboxyl, cyano, and alkoxy, such as methoxy and ethoxy, acyl, sulfonyl, hydroxy, alkoxycarbonyl, and aryloxy.

Preferred timing groups include:

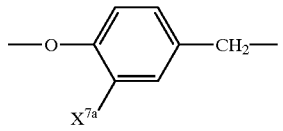

wherein $X^{7a}$ is hydrogen, chlorine, methylsulfonamido ($NHSO_2CH_3$), —$COOCH_3$, —$NHCOCH_3$, —$CONHCH_3$, —$COHNCH_2COOH$, —COOH or $CON(CH_3)_2$.

Another preferred timing group based on an aromatic hydrocarbyl group has the formula:

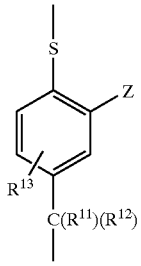

wherein Z is selected from the group consisting of nitro, cyano, alkylsulfonyl; sulfamoyl (—$SO_2NR_2$); and sulfonamido (—$NRSO_2R$) groups; R is hydrogen or a substituent such as alkyl; $R^{13}$, $R^{11}$ and $R^{12}$ are independently hydrogen or substituents that do not adversely affect the coupling and release reactions or the properties of the dyes formed thereby.

The timing group and DYE' optionally contain substituents that can modify the rate of reaction, diffusion, or displacement, such as halogen, including fluoro, chloro, bromo, or iodo, nitro, alkyl of 1 to 20 carbon atoms, acyl, carboxy, carboxyalkyl, alkoxycarbonyl, alkoxycarbonamido, alkylcarbamyl, sulfoakyl, alkylsulfonamido, and alkylsulfonyl, solubilizing groups, ballast groups and the like. For example, solubilizing groups will increase the rate of diffusion and ballast groups will decrease the rate of diffusion.

In a preferred embodiment of the invention, the coupler is represented by the following Formula IIIA.

IIIA

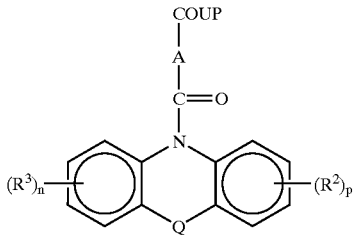

wherein A is O or S and Q is O, S, or NR', wherein R' is a hydrogen, alky, or aryl group and $R^2$, $R^3$, n, and p are as described above.

COUP of the invention is the parent portion of the coupler. This is the portion of the coupler that combines with oxidized color developer in a conventional process to form a colored image dye. The various types of couplers are described more fully hereinafter. In the preferred embodiment of the invention the COUP group is one which releases a high extinction dye or dye precursor such as a leuco dye. Equivalently, the linking group in the above formula IA may be viewed as a carbamyloxy group when the necessary N linkage of DYE' is considered.

In a preferred embodiment, DYE' produces a cyan dye, i.e. the same color as that formed by COUP upon reaction with oxidized developer. When the cyan DYE' moiety is appended to the coupler through the acyloxy group, it is conveniently shifted to the invisible UV range and thus remains colorless unless and until detached from COUP in an imagewise fashion. In a preferred embodiment when the DYE' group is released, it forms a leuco dye. The leuco dye is then converted to the colored dye form by an oxidation involving the removal of a hydrogen and a pair of electrons.

One useful embodiment of couplers of the present invention is represented by the Structure IV:

IV

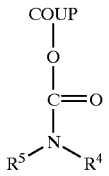

wherein in the above formula $R^4$ is interconnected with $R^5$ to form together with the nitrogen atom, to which they are connected, a ring system selected from the group of phenothiazine, phenoxazine, phenazine or derivatives thereof.

The derivatives of the above $R^4$ and $R^5$ preferably contain groups on the ring system in at least the para and/or pseudo-para position relative to the nitrogen in Structure IV, which groups are electron donating.

Preferably the group at the para or pseudo- para position is an alkyl group, aralkyl group, aryl group, alkaryl, $OR^6$, $SR^6$, or $NR^7R^8$ wherein each $R^6$, $R^7$, and $R^8$ are individually hydrogen or an alkyl group usually containing 1 to 8 carbon atoms and preferably 1 to 4 carbon atoms. The above groups can also be present at other positions on the rings of $R^4$ and $R^5$ if desired.

The alkyl group usually contains 1 to 22 carbon atoms and preferably 1 to 4 carbon atoms. Examples of some alkyl groups are methyl, ethyl, butyl, amyl, and hexyl. Examples of some aralkyl groups include tolyl, xylyl, and cumyl. The aryl groups contain 6 to 14 carbon atoms and include phenyl, naphthyl, and anthracyl. An example of an alkaryl group is benzyl.

Preferred DYE' compounds employed in accordance with the present invention are represented by the following formula:

V

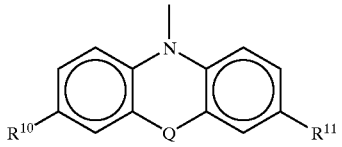

wherein Q is S or O or NR, and each $R^{10}$ and $R^{11}$ of the above formula individually is a group capable of donating an electron and is preferably selected from the group of $SR^{12}$, $OR^{13}$, and $NR^{14}R^{15}$. Each $R^{12}$, $R^{13}$, and $R^{14}$ is individually hydrogen or an alkyl group generally containing 1 to 8 carbon atoms. Each $R^{15}$ is an alkyl group usually containing 1 to 8 carbon atoms. The most preferred $R^{10}$ and $R^{11}$ groups are OH, $N(CH_3)_2$, and $N(C_2H_5)_2$.

An example of a particularly preferred cyan DYE' within the scope of the present invention, which forms Methylene Blue after release and oxidation, is represented by the following formula:

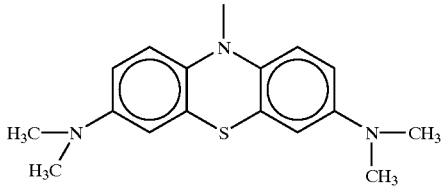

Compounds within the scope of the present invention can be prepared by those skilled in the art, as exemplified in the Examples below.

The first and second dyes are the same cyan color in a high dye-yield coupler. By the same color it is meant they have an absorption maximum within 75 nm of each other. The first dye is not formed until the development process. The second dye is shifted to the non-visible (colorless) region so long as the leuco DYE' is bonded to the rest of the coupler via OC═O but becomes colored upon release and oxidized by air, oxidized developer, silver halide, or other oxidant.

Couplers that form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; and 4,333,999.

Preferably such couplers are phenols and naphthols that form cyan dyes onf reaction with oxidized color developing agent and have the —$(T)_m$—L—(Dye') attached to the coupling position, i.e. the carbon atom in the 4-position. (In the following structures, Y represents the coupling off group which is —$(T)_m$—L—(Dye') as defined above according to this invention. Structures of preferred such coupler moieties are as follows:

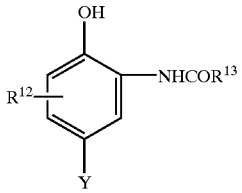

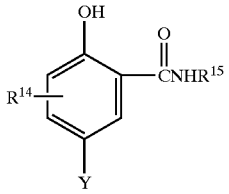

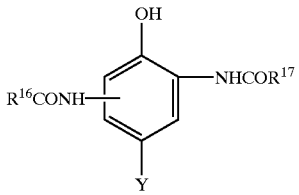

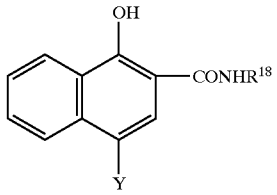

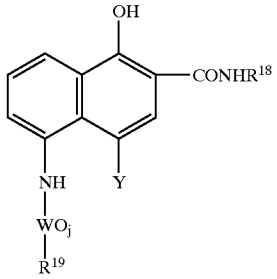

wherein $R^{13}$, $R^{15}$, $R^{16}$, $R^{17}$ and $R^{18}$ represent ballast groups, and $R^{12}$ and $R^{14}$ represent one or more halogen (e.g. chloro, fluoro), lower alkyl (e.g. methyl, ethyl, butyl), lower alkoxy (e.g. methoxy, ethoxy, butoxy) groups, or ballast groups. W can be either C or S (j is 1 when W is C, and j is 2 when W is S) and $R^{19}$ is preferably an alkyl or alkoxy.

The following are examples of couplers useful in the photographic element of the invention.

IC-1

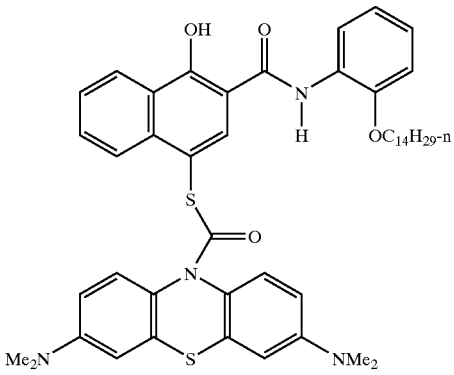

IC-2

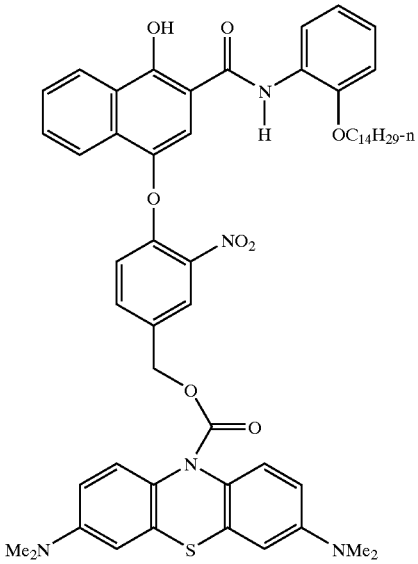

IC-3

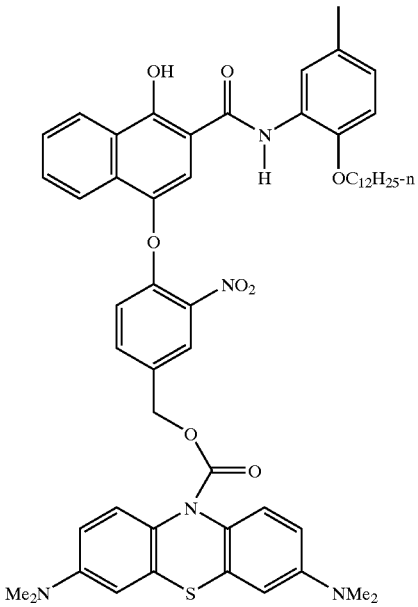

-continued
IC-4
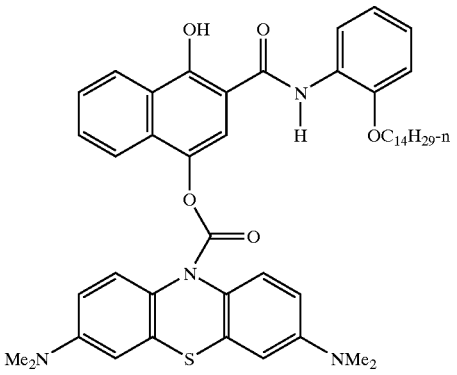
IC-5
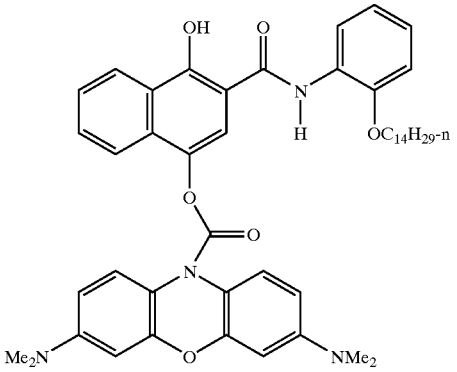
IC-6
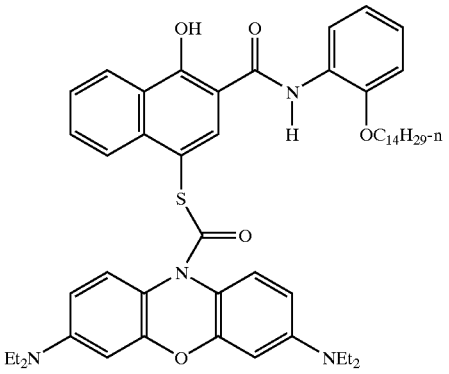
IC-7
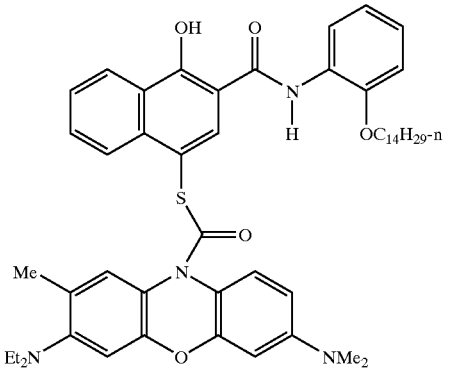
-continued
IC-8
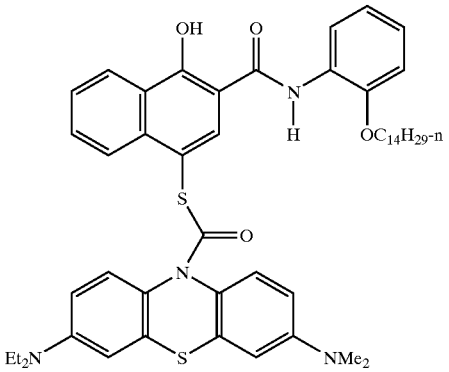
IC-9
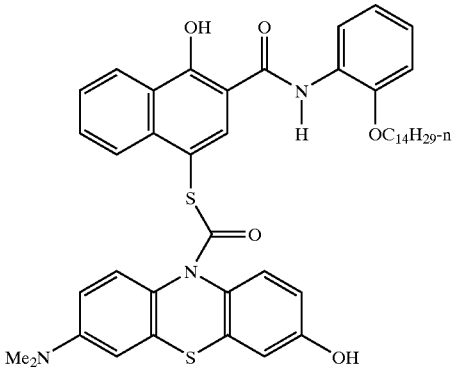
IC-10
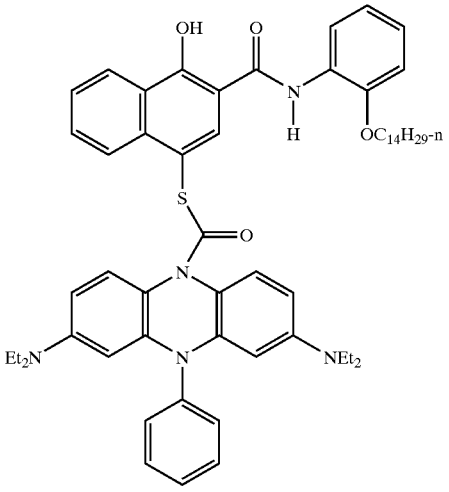

-continued

IC-11

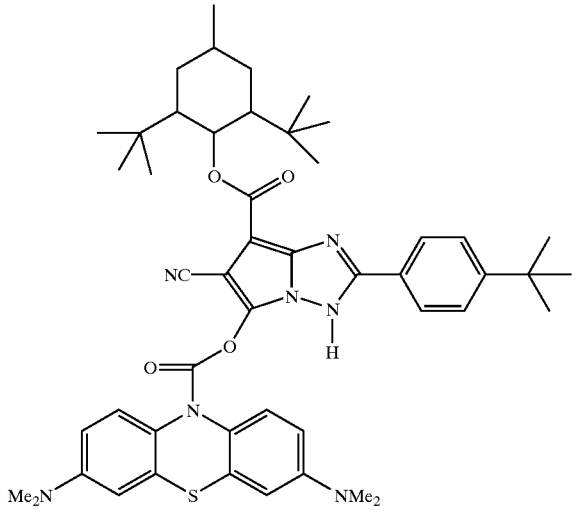

IC-12

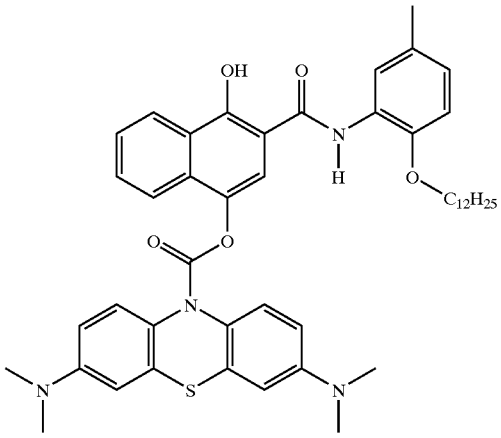

IC-13

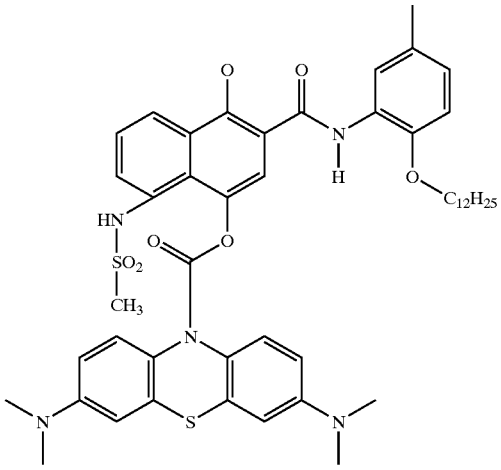

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N—(m-hexadecylphenyl)ureido, N,N-(2,5-di-t-pentylphenyl)-N'-ethylureido, and t-butylcarbonamido; sulfonarnido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfmyl, octylsulfinyl, 2-ethylhexylsulfmyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy- 5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element.

The dye-forming couplers useful in the invention can be incorporated in the imaging member in any manner known in the art. These methods include, but are not limited to, incorporation as oil-in-water emulsions, known colloquially in the photographic arts as "dispersions," as reverse phase emulsion, as solid particle dispersions, as multiphase dispersions, as molecular dispersions or "Fisher" dispersions, or as polymer loaded dispersions or loaded latex dispersions. While the HDY coupler can be employed in the member at any concentration that enables the desired formation of a multicolor image, it is preferred that the HDY coupler be applied to the member at between about 50 and 3000 mg/m$^2$. It is more preferred that the HDY coupler be applied to the member at between about 200 and 800 mg/m$^2$.

The imaging member can further comprise an incorporated solvent. In one embodiment the HDY coupler is provided as an emulsion in such a solvent. In this embodiment, any of the high boiling organic solvents known in the photographic arts as "coupler solvents" can be employed. In this situation, the solvent acts as a manufacturing aid. Alternatively, the solvent can be incorporated separately. In both situations, the solvent can further function as a coupler stabilizer, a dye stabilizer, a reactivity enhancer or moderator or as a hue shifting agent, all as known in the photographic arts. Additionally, auxiliary solvents can be employed to aid dissolution of the HDY coupler in the coupler solvent. Particulars of coupler solvents and their use are described in the aforesaid mentioned references and at *Research Disclosure,* Item 37038 (1995), Section IX, Solvents, and Section XI, Surfactants, incorporated herein by reference. Some specific examples of coupler solvents include, but are not limited to, tritolyl phosphate, dibutyl phthalate, N,N-diethyldodecanamide, N,N-dibutyldodecanamide, tris(2-ethylhexyl)phosphate, acetyl tributyl citrate, 2,4-di-tert-pentylphenol, 2-(2-butoxyethoxy) ethyl acetate and 1,4-cyclohexyldimethylene bis(2-ethylhexanoate). The choice of coupler solvent and vehicle can influence the hue of dyes formed as disclosed by Merkel et al at U.S. Pat. Nos. 4,808,502 and 4,973,535. Typically, it is found that materials with a hydrogen bond donating ability can shift dyes bathochromically while materials with a hydrogen bond accepting ability can shift dyes hypsochromically. Additionally, use of materials with low polarizability can of itself promote hypsochromic dye hue shifts as well as promote dye aggregation. It is recognized that coupler ballasts often enable dyes and dye-coupler mixtures to function as self-solvents with a concomitant shift in hue. The polarizability, and the hydrogen bond donating and accepting ability of various materials are described by Kamlet et al in *J. Org. Chem,* 48, 2877–87 (1983), the disclosures of which are incorporated by reference.

When the formed image is intended for human viewing, at least one imaging layer is cyan dye forming, at least one other imaging layer is magenta dye forming, and at least one third imaging layer is yellow dye forming. Preferably, therefore, each coupler is present, in reactive association, with a blocked developer. However, if the formed image is to be scanned, it is possible to produce other distinctly colored dyes. By distinctly colored is meant that the dyes formed differ in the wavelength of maximum adsorption by at least 50 nm. It is preferred that these dyes differ in the maximum adsorption wavelength by at least 65 nm and more preferred that they differ in the maximum adsorption wavelength by at least 80 nm. It is further preferred that, in addition to the cyan dye, a magenta and a yellow dye are formed. Preferably a cyan dye-forming developer, a magenta dye-forming developer and a yellow dye-forming developer are employed to form respectively cyan, magenta and yellow dyes from the same coupler. In another embodiment, a black dye forming developer is additionally employed. In yet another embodiment multiple cyan dye forming, magenta dye forming and yellow dye forming developers can be individually employed to form a greater gamut of colors or to form colors at greater bit depth.

A cyan dye is a dye typically having a maximum absorption at between 580 and 700 nm, with preferably a maximum absorption between 590 and 680 nm, more preferably a peak absorption between 600 and 670 nm and most preferably a peak absorption between 605 and 655 nm. A magenta dye is a dye having a maximum absorption at between 500 and 580 nm, with preferably a maximum absorption between 515 and 565 nm, more preferably a peak absorption between 520 and 560 nm and most preferably a peak absorption between 525 and 555 nm. A yellow dye is a dye having a maximum absorption at between 400 and 500 nm, with preferably a maximum absorption between 410 and 480 nm, more preferably a peak absorption between 435 and 465 nm and most preferably a peak absorption between 445 and 455 nm.

In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red light recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

The concentrations and amounts of the one or more developers and the one or more dye-forming couplers in the photographic element will typically be chosen so as to enable the formation of dyes having a density at maximum absorption of at least 0.7, preferably a density of at least 1.0, more preferably a density of at least 1.3 and most preferably a density of at least 1.6. Further, the dyes will typically have a half height band width (HHBW) of between 70 and 170 nm in the region between 400 and 900 nm. Preferably, the HHBW will be less than 150 nm, more preferably less than 130 nm and most preferably less than 115 nm. Additional details of preferred dye hues are described by McInerney et al in U.S. Pat. Nos. 5,679,139, 5,679,140, 5,679,141 and 5,679,142, the disclosures of which are incorporated by reference.

In addition to HDY couplers, other couplers may be used in the photographic element. Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616. 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099, 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers which can be used in addition to HDY couplers of the present invention that form cyan dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848;

5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196, EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632, 345; 3,928,041; 3,958,993 and 3,961,959. Typically such couplers are cyclic carbonyl containing compounds that form colorless products on reaction with an oxidized color developing agent In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. Nos. 4,301,235; 4,853, 319 and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983, 608; 4,070,191, and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. Nos. 4,163, 669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237, EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Development Inhibitor-Releasing" compounds (DIR's). DIR's usefil in conjunction with the compositions of the invention are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252; 365, 346; 373,382; 376,212; 377,463; 378,236; 384,670; 396, 486; 401,612; 401,613.

Such compounds are also disclosed in "Development-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, tbiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

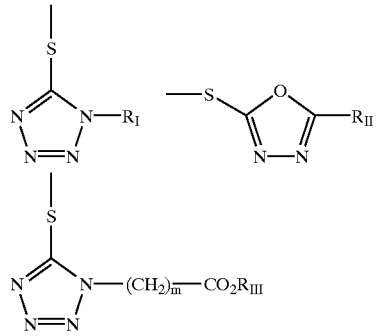

-continued

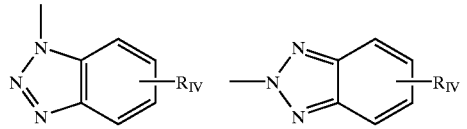

wherein $R^I$ is selected from the group consisting of straight and branched alkyls of from 1 to about 8 carbon atoms, benzyl, phenyl, and alkoxy groups and such groups containing none, one or more than one such substituent; $R^{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that are known to wash out of the photographic material during conventional processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

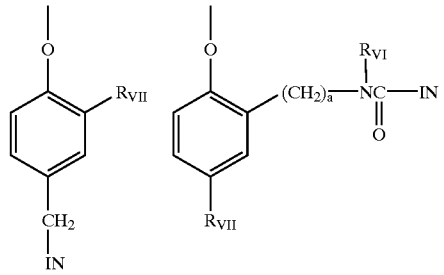

wherein IN is the inhibitor moiety, $R_{VII}$ is selected from the group consisting of nitro, cyano, alkylsulfonyl, sulfarnoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| 1L2 | Second Interlayer |
| RU | Red Recording Layer Unit |
| AHU | Antihalation Layer Unit |
| S | Support |
| SOC | Surface Overcoat |

Details of support construction are well understood in the art. Examples of useful supports are poly(vinylacetal) film, polystyrene film, poly(ethyleneterephthalate) film, poly (ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure,* September 1996, Number 389, Item 38957 (hereafter referred to as ("*Research Disclosure I*").

The photographic elements of the invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945, and 4,302,523.

In the above scheme, each of blue, green and red recording layer units BU, GU and RU are formed of one or more hydrophilic colloid layers and contain at least one radiation-sensitive silver halide emulsion, including the developing agent and, in certain embodiments, the common dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. In this case, the coupler containing layer is usually the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m. In another embodiment, sensitized layers disposed on two sides of a support, as in a duplitized film, can be employed.

In a preferred embodiment of this invention, involving films designed for scanning, the processed photographic film contains only limited amounts of color masking couplers, incorporated permanent Dmin adjusting dyes and incorporated permanent antihalation dyes. Generally, such films contain color masking couplers in total amounts up to about 0.6 mMol/m$^2$, preferably in amounts up to about 0.2 mMol/m$^2$, more preferably in amounts up to about 0.05 mMol/m$^2$, and most preferably in amounts up to about 0.01 mMol/m$^2$.

The incorporated permanent Dmin adjusting dyes are generally present in total amounts up to about 0.2 mMol/m$^2$, preferably in amounts up to about 0.1 mMol/m$^2$, more preferably in amounts up to about 0.02 mMol/m$^2$, and most preferably in amounts up to about 0.005 mMol/m$^2$.

The incorporated permanent antihalation density is up to about 0.6 in blue, green or red density, more preferably up to about 0.3 in blue, green or red density, even more preferably up to about 0.1 in blue, green or red density and most preferably up to about 0.05 in blue, green or red Status M density.

Limiting the amount of color masking couplers, permanent antihalation density and incorporated permanent Dmin adjusting dyes serves to reduce the optical density of the films, after processing, in the 350 to 750 nm range, and thus improves the subsequent scanning and digitization of the imagewise exposed and processed films.

Overall, the limited Dmin and tone scale density enabled by controlling the quantity of incorporated color masking couplers, incorporated permanent Dmin adjusting dyes and antihalation and support optical density can serve to both limit scanning noise (which increases at high optical densities), and to improve the overall signal-to-noise characteristics of the film to be scanned. Relying on the digital correction step to provide color correction obviates the need for color masking couplers in the films.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. However, in a preferred embodiment, a preponderance low reflectivity grains are preferred. By preponderance is meant that greater than 50% of the grain projected area is provided by low reflectivity silver halide grains. It is even more preferred that greater than 70% of the grain projected area be provided by low reflectivity silver halide grains. Low reflective silver halide grains are those having an average grain having a grain thickness >0.06, preferably >0.08, and more preferable >0.10 microns. The grains preferably form surface latent images so that they produce negative images when processed in a surface developer in color negative film forms of the invention.

Illustrations of conventional radiation-sensitive silver halide emulsions are provided by *Research Discloszire* I, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure* I, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm, et al., U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements (including photothermographic and non-photothermographic elements) of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure,* I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be not more than 4.5 g/m$^2$ of silver, preferably less. Silver quantities of less than 4.0 g/m$^2$ are preferred and silver quantities of less than 3.5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.0 g of coated silver per m$^2$ of support surface area in the element is necessary to realize an exposure latitude of at least 2.7 log E while maintaining an adequately low graininess position for pictures intended to be enlarged. Silver coverages in excess of 1.5 g/m$^2$ are preferred while silver coverages in excess of 2.5 g/m$^2$ are more preferred.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction-i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure* I, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure* I, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure* I, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

When a layer unit contains two or more emulsion layers differing in speed, it is possible to lower image granularity in the image to be viewed, recreated from an electronic record, by forming in each emulsion layer of the layer unit a dye image which exhibits an absorption half-peak bandwidth that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.00 or even 0.6 are contemplated and exposure latitudes of up to about 5.0 log E or higher are feasible. Gammas above 0.25 are preferred and gammas above 0.30 are more preferred. Gammas of between about 0.4 and 0.5 are especially preferred.

In photothermographic embodiments, typically one or more developer precursors are employed in the practice of this invention, which developer precursors are incorporated in the imaging element during manufacture, at least one of which is in reactive association with the yellow HDY coupler according to the present invention. When the term "associated" is employed, it signifies that a reactive compound is in or adjacent to a specified layer where, during processing, it is capable of reacting with other components. In a preferred embodiment the dye image is formed by the use of an incorporated developing agent, in reactive association with each color layer. More preferably, the incorporated developing agent is a blocked developing agent.

Examples of blocking groups that can be used in photographic elements of the present invention include, but are not limited to, the blocking groups described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Other examples of blocking groups that can be used in photographic elements of the present invention include, but are not limited to, the blocking groups described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocking groups described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30,1999, PHOTOGRAPHIC OR PHOTOTHERMOGRAPHIC ELEMENT CONTAINING A BLOCKED PHOTOGRAPHICALLY USEFUL COMPOUND. In one embodiment of the invention, the blocked developer may be represented by the following Structure III:

$$\text{DEV—(LINK 1)}_{1}\text{—(TIME)}_{m}\text{—(LINK 2)}_{n}\text{—B}$$

wherein,

DEV is a silver-halide color developing agent according to the present invention;

LINK 1 and LINK 2 are linking groups;

TIME is a timing group;

1 is 0 or 1;

m is 0, 1, or 2;

n is 0 or 1;

1+n is 1 or 2;

B is a blocking group or B is:

$$\text{—B'—(LINK 2)}_{n}\text{—(TIME)}_{m}\text{—(LINK 1)}_{1}\text{—DEV}$$

wherein B' also blocks a second developing agent DEV.

In a preferred embodiment of the invention, LINK 1 or LINK 2 are of structure IV:

IV

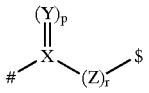

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur, r is 0 or 1, with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

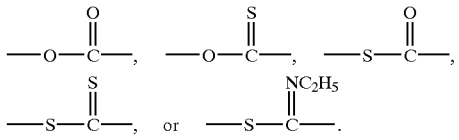

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60–249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Although the present invention is not limited to any type of developing agent or blocked developing agent, the following are merely some examples of photographically useful blocked developers that may be used in the invention to produce developers of Structure III.

Other blocked developers that can be used are, for example, those blocked developers disclosed in U.S. Pat. No. 6,303,282 B1 to Naruse et al., U.S. Pat. No. 4,021,240 to Cerquone et al., U.S. Pat. No. 5,746,269 to Ishikawa, U.S. Pat. No. 6,130,022 to Naruse, and U.S. Pat. No. 6,177,227 to Nakagawa, and substituted derivatives of these blocked developers. Although the present invention is not limited to any type of developing agent or blocked developing agent, the following are merely some examples of some photographically useful blocked developers that may be used in the invention to produce developers during heat development.

D-1

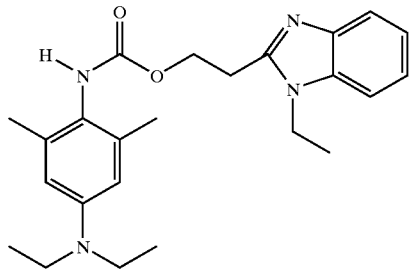

D-2

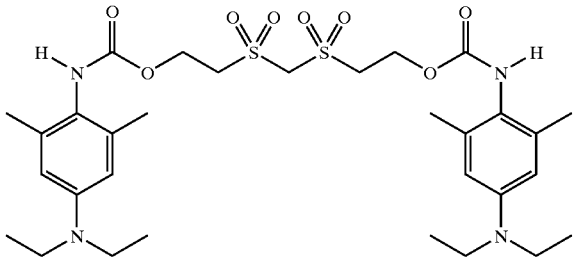

D-3

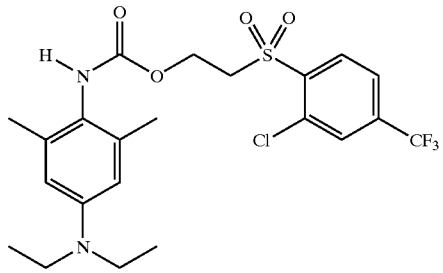

D-4

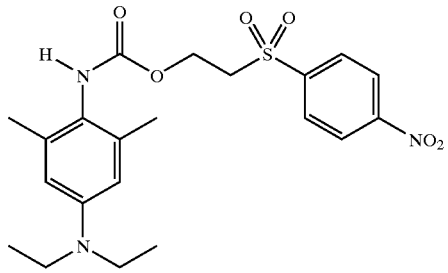

D-5

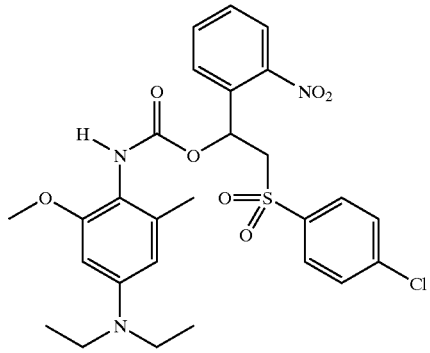

-continued

D-6

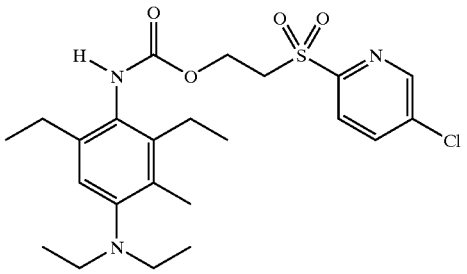

D-7

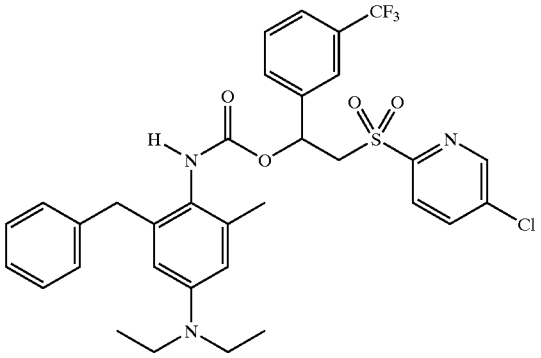

D-8

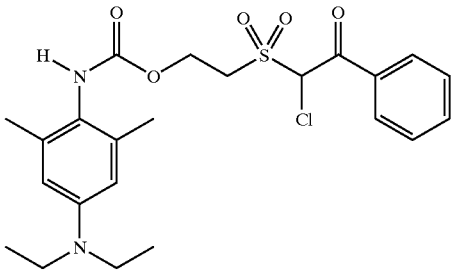

D-9

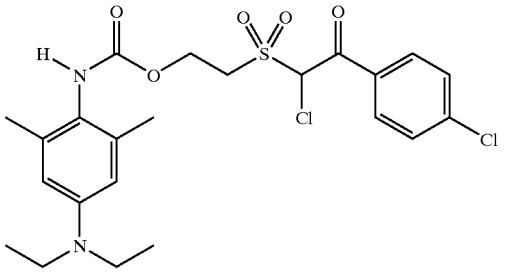

D-10

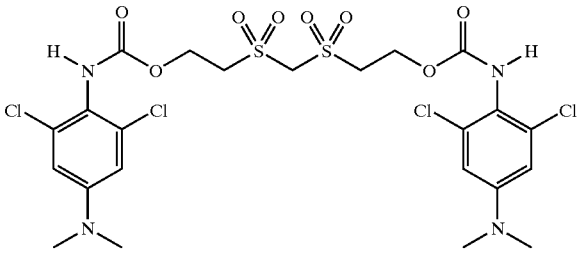

-continued

D-11

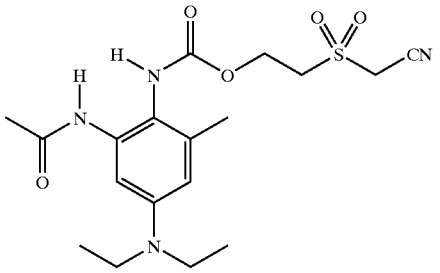

D-12

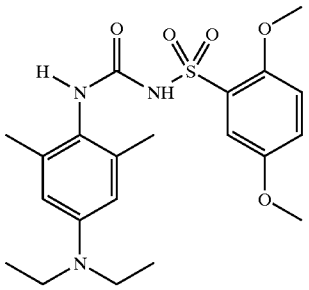

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise apan-sensitized emulsion with accompanying color-separation exposure. In this embodiment, the developers of the invention would give rise to a colored or neutral image that, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering,* W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. In a like vein, it is preferred that the gamma ratios be greater than 0.8, more preferred that they be greater than 0.85 and most preferred that they be greater than 0.9. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic or photothermographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. No. 4,890,130 and 5,063,400; providing an electronic flash means as described at Ohmura et al, U.S.

Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in Stoebe, et al., U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

As mentioned above, the photographic elements of the present invention can be photothermographic elements of the type described in *Research Disclosure* 17029 are included by reference. The photothermographic elements may be of type A or type B as disclosed in *Research Disclosure* I. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

A photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

A second silver salt with a fog inhibiting property may also be used. The second silver organic salt, or thermal fog inhibitor, according to the present invention include silver salts of thiol or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole.

The second organic silver salt may be a derivative of a thionamide. Specific examples would include but not be limited to the silver salts of 6-chloro-2-mercapto benzothiazole, 2-mercapto-thiazole, naptho(1,2-d)thiazole-2(1H)-thione, 4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

Preferably, the second organic silver salt is a derivative of a mercapto-triazole. Specific examples would include, but not be limited to, a silver salt of 3-mercapto-4-phenyl-1,2,4 triazole and a silver salt of 3-mercapto-1,2,4-triazole.

Most preferably the second organic salt is a derivative of a mercapto-tetrazole. In one preferred embodiment, a mercapto tetrazole compound useful in the present invention is represented by the following structure VI:

VI

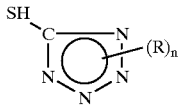

wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 6 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl]-5-mercapto-tetrazole.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure,* Item 17029, cited above, as well as U.S. Pat. No. 3,700,458 and published Japanese patent applications Nos. 32928/75, 13224/74, 17216/75 and 42729/76.

A photothermographic element can comprise a thermal solvent. Examples of useful thermal solvents. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure,* June 1978, Item No. 17029 and U.S. Pat. No. 4,123,282.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

After imagewise exposure of a photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed by Stoebe, et al., U.S. Pat. No. 6,062,746 and Szajewski, et al., U.S. Pat. No. 6,048,110, commonly assigned, which are incorporated herein by reference. The use of an apparatus whereby the processor can be used to write information onto the element, information which can be used to adjust processing, scanning, and image display is also envisaged. This system is disclosed in now allowed Stoebe, et al., U.S. patent applications Ser. No. 09/206,914 filed Dec. 7, 1998 and Ser. No. 09/333,092 filed Jun. 15, 1999, which are incorporated herein by reference.

Thermal processing is preferably carried out under ambient conditions of pressure and humidity. Conditions outside of normal atmospheric pressure and humidity are useful.

In view of advances in the art of scanning technologies, it has now become natural and practical for photographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443.

Nevertheless, the retained silver halide can scatter light, decrease sharpness and raise the overall density of the film thus leading to impaired scanning. Further, retained silver halide can printout to ambient/viewing/scanning light, render non-imagewise density, degrade signal-to noise of the original scene, and raise density even higher. Finally, the retained silver halide and organic silver salt can remain in reactive association with the other film chemistry, making the film unsuitable as an archival media. Removal or stabilization of these silver sources are necessary to render to an archival state.

Furthermore, the silver coated in the PTG film (silver halide, silver donor, and metallic silver) is unnecessary to the dye image produced, and this silver is valuable and the desire is to recover it is high.

Thus, it may be desirable to remove, in subsequent processing steps, one or more of the silver containing components of the film: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical as known in the photographic arts. Specific examples of useful chemicals include: thioethers, thioureas, thiols, thiones, thionamides, amines, quaternary amine salts, ureas, thiosulfates, thiocyanates, bisulfites, amine oxides, iminodiethanol - sulfur dioxide addition complexes, amphoteric amines, bis-sulfonylmethanes, and the carbocyclic and heterocyclic derivatives of these compounds. These chemicals have the ability to form a soluble complex with silver ion and transport the silver out of the film into a receiving vehicle. The receiving vehicle can be another coated layer (laminate) or a conventional liquid processing bath.

The stabilization of the silver halide and silver donor can also be accomplished with a common stabilization chemical. The previously mentioned silver salt removal compounds can be employed in this regard. With stabilization, the silver is not necessarily removed from the film, although the fixing agent and stabilization agents could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning.

The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the PTG film. Therefore, if stabilization of the PTG film is favored over removal of silver, the bleach step can be skipped and the metallic silver left in the film. In cases where the metallic silver is removed, the bleach and fix steps can be done together (called a blix) or sequentially (bleach +fix).

The process could involve one or more of the scenarios or permutations of steps. The steps can be done one right after another or can be delayed with respect to time and location. For instance, heat development and scanning can be done in a remote kiosk, then bleaching and fixing accomplished several days later at a retail photofinishing lab. In one embodiment, multiple scanning of images is accomplished. For example, an initial scan may be done for soft display or a lower cost hard display of the image after heat processing, then a higher quality or a higher cost secondary scan after stabilization is accomplished for archiving and printing, optionally based on a selection from the initial display.

For illustrative purposes, a non-exhaustive list of photothermographic film processes involving a common dry heat development step are as follows:

1. heat development=>scan=>stabilize (for example, with a laminate)=>scan=>obtain returnable archival film.
2. heat development=>fix bath=>water wash=>dry=>scan=>obtain returnable archival film
3. heat development=>scan=>blix bath=>dry=>scan=>recycle all or part of the silver in film
4. heat development=>bleach laminate=>fix laminate=>scan=>(recycle all or part of the silver in film)
5. heat development=>scan=>blixbath=>wash=>fix bath=>wash=>dry=>obtain returnable archival film
6. heat development=>relatively rapid, low quality scan
7. heat development=>bleach=>wash=>fix=>wash=>dry=>relatively slow, high quality scan In a preferred embodiment of a photothermographic film according to the present invention, the processing time to first image (either hard or soft display for customer/consumer viewing), including (i) thermal development of a film, (ii) scanning, and (iii) the formation of the positive image from the developed film, is suitably less than 5 minutes, preferably less than 3.5 minutes, more preferably less than 2 minutes, most preferably less than about 1 minute. In one embodiment, such film might be amenable to development at kiosks, with the use of simple dry or apparently dry equipment. Thus, it is envisioned that a consumer could bring an imagewise exposed photographic film, for development and printing, to a kiosk located at any one of a number of diverse locations, optionally independent from a wet-development lab, where the film could be developed and printed without any manipulation by third-party technicians. A photothermographic color film, in which a silver-halide-containing color photographic element after imagewise exposure can be developed merely by the external application of heat and/or relatively small amounts of alkaline or acidic water, but which same film is also amenable to development in an automated kiosk, preferably not requiring third-party manipulation, would have significant advantages. Assuming the availability and accessibility of such kiosks, such photothermographic films could potentially be developed at any time of day, "on demand," in a matter minutes, without requiring the participation of third-party processors, multiple-tank equipment and the like. Optional, such photographic processing could potentially be done on an "as needed" basis, even one roll at a time, without necessitating the high-volume processing that would justify, in a commercial setting, equipment capable of high-throughput. Color development and subsequent scanning of such a film could readily occur on an individual consumer basis, with the option of generating a display element corresponding to the developed color image. By kiosk is meant an automated free-standing machine, self-contained and (in exchange for certain payments) capable of developing a roll of imagewise exposed film on a roll-by-roll basis, without the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably 3 cubic meters or less in dimension, and hence commercially transportable to diverse locations. Such kiosks may optionally comprise a heater for color development, a scanner for digitally recording the color image, and a device for transferring the color image to a display element.

Photothermographic or photographic elements of the present invention can also be subjected to low volume processing ("substantially dry" or "apparently dry") which is defined as photographic processing where the volume of applied developer solution is less than one times the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

Photographic elements designed for low-volume processing may receive some or all of the following three treatments:

(I) Application of a solution directly to the film by any means, including spray, inkjet, coating, gravure process and the like.

(II) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

Heating of the element during processing may be effected by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Once yellow, magenta, and cyan dye image records (or the like) have been formed in the processed photographic elements of the invention, conventional techniques can be employed for retrieving the image information for each color record and manipulating the record for subsequent creation of a color balanced viewable image. For example, it is possible to scan the photothermographic element successively within the blue, green, and red regions of the spectrum or to incorporate blue, green, and red light within a single scanning beam that is divided and passed through blue, green, and red filters to form separate scanning beams for each color record. A simple technique is to scan the photothermographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management,* Addison-Wesley, 1998.

EXAMPLES

Preparative Examples

The following examples illustrate the synthesis of representative blocked compounds useful in the invention.

Preparation of Leuco Methylene Blue Carbamyl Chloride (1)

Methylene Blue (32 g, 0.1 mol), 200 mL of methylene chloride, and 250 mL of warm (40°) water were placed in a 2-L round bottom flask fitted with mechanical stirrer, thermometer, condenser, and nitrogen inlet. Sodium dithionite (35 g, 0.2 mol) and sodium bicarbonate (16.8 g, 0.2 mol) were mixed as dry powders and then slowly added to the vigorously stirred solution under nitrogen atmosphere. The solution was stirred for a few minutes until all of the methylene blue had dissolved and the blue color of the aqueous phase had faded to almost colorless. The light brown methylene chloride phase was separated by transferring the reaction mixture to a separatory funnel. A small amount of magnesium sulfate was added to dry the crude leuco dye before filtering the solution quickly into a round bottom flask containing triethylamine (17 mL, 0.12 mol) and a magnetic stir bar. The flask was cooled by a cold water bath before introducing a solution of phosgene in toluene (60 mL of 2M solution, 0.12 mol). After stirring for a few minutes, the solution was poured into a separatory funnel, washed with water, dried over magnesium sulfate, filtered through a small pad of silica gel, and concentrated to a crude solid. The solid was slurried in acetonitrile, filtered, washed, and dried to 23.7 g (68%) of white solid leuco methylene blue carbamyl chloride (1).

Preparation of IC-1:

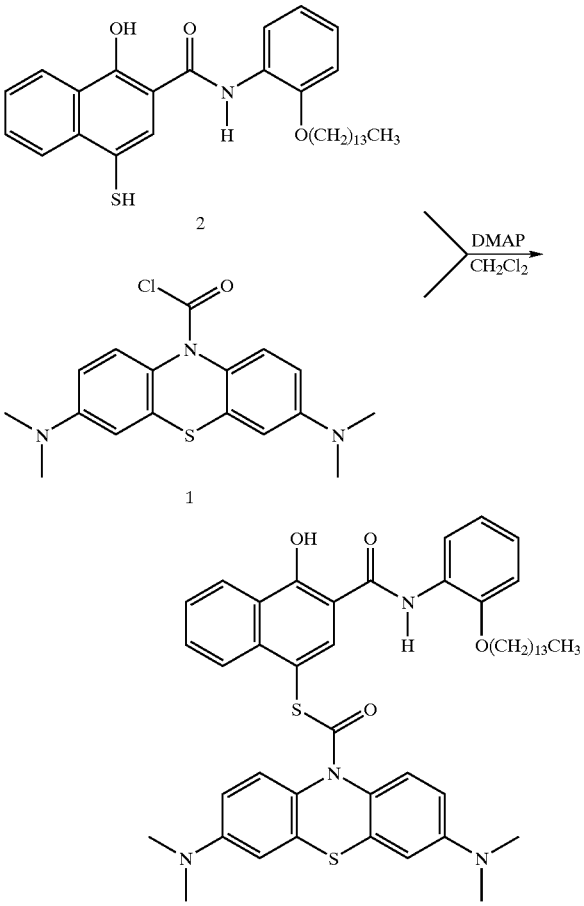

Solid 4-N,N-Dimethylpyridine (DMAP, 1.22 g, 10 mMol) was added in portions over a period of 15 min to a suspension of compounds 2 (2.53 g, 5 mMol) and 1 (1.74 g, 5 mMol) in 20 ml of dichloromethane, stirred at 5° C. Following the addition, the mixture was stirred at 5° C. for 30 min and diluted with dichloromethane (20 ml). The solution was washed with saturated aqueous sodium bicarbonate (2×20 ml), dried over sodium sulfate and concentrated Purification by column chromatography (silica gel, dichloromethane) yielded 2.96 g (3.6 mMol, 72%) of IC-1, m.p. 91–92° C.; ESMS: ES+, m/z 819 (M+1, base); ES−, m/z 817 (M−1, base).

Preparation of IC-2:

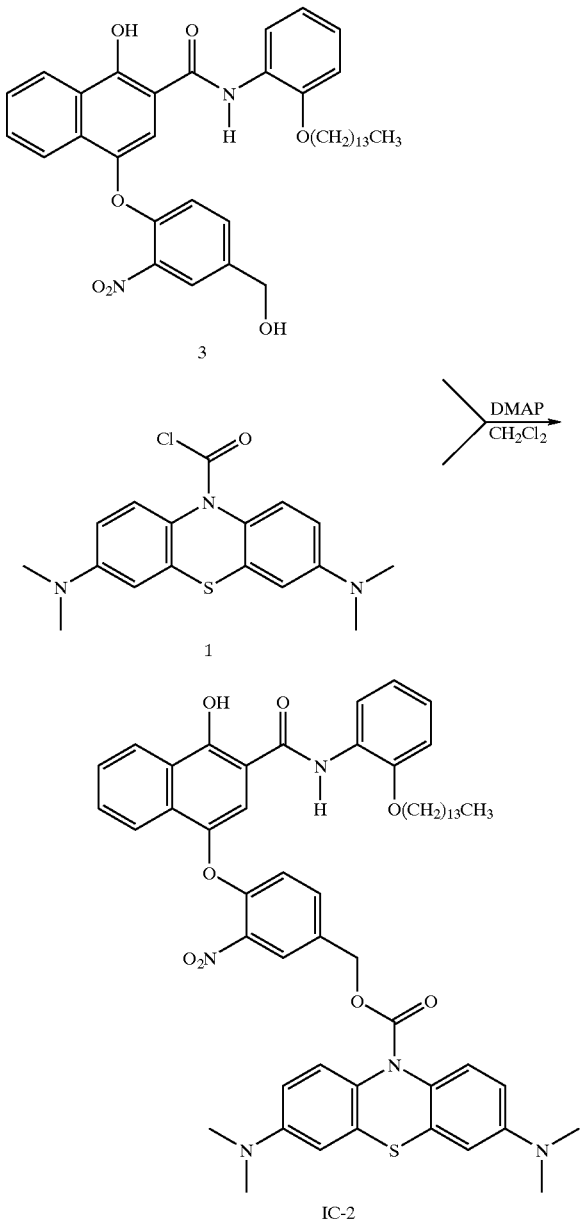

Solid DMAP (1.22 g, 10 mMol) was added in portions at 5° C. over a period of 15 min to a mixture of compounds 1 (1.74 g, 5 mMol) and 3 (3.21 g, 5 mMol) in 20 ml of dichloromethane. Next, the resulting solution was kept at room temperature for 2 h and filtered through silica gel, giving 0.82 g (0. 85 mMol, 17%) of IC-2 as an oil; ESMS: ES+, m/z 954 (M+1, base); ES−, m/z 952 (M−1, base).

Preparation of IC-3:

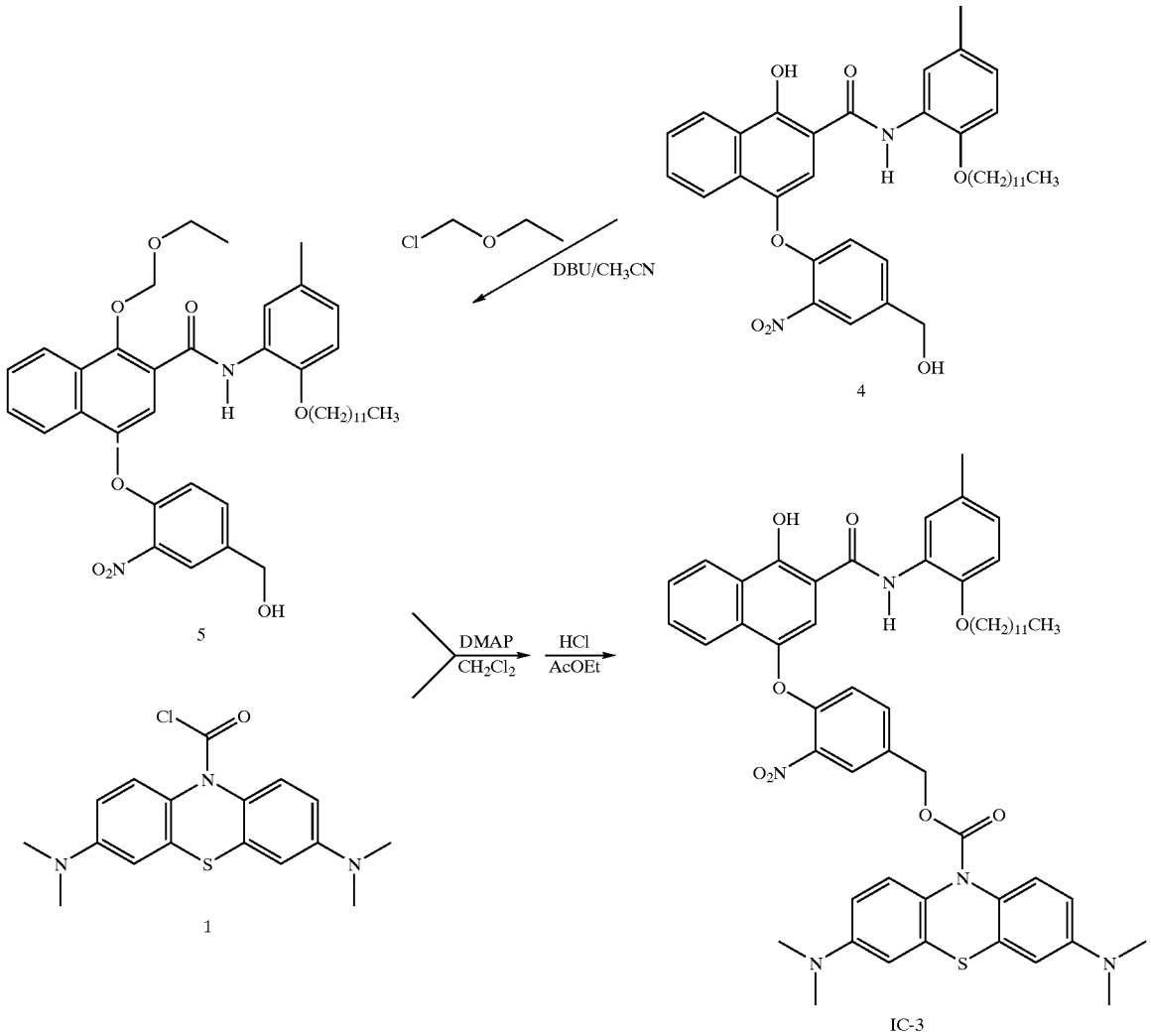

Preparation of 5

Neat chloromethyl ethyl ether (5.20 g, 55 mMol) was added in drops over a period of 15 min to a mixture of compound 4 (31.45 g, 50 mMol) and 1,8-diazabicyclo[5.4.0] undec-7-ene (DBU, 8.37 g, 55 mMol) in 200 ml of acetonitrile, that was stirred at 5° C. under nitrogen. The reaction mixture was then stirred at room temperature for 2 h while being treated periodically with three portions, 1.52 g (10 mMol) each, of DBU and three portions, 0.95 g (10 mMol) each, of chloromethyl ethyl ether. The mixture was then poured into 1.5 l of water/500 ml of ether and stirred for 18 h giving a solid. The product was filtered off, washed with 3×300 ml of water, briefly air-dried and stirred with 600 ml of isopropyl ether for 24 h. The product was then recollected, washed with isopropyl ether (2×100 ml), hexanes (2×200 ml) and dried in vacuo for 3 days. The yield of 5 was 31.43 g (46 mMol, 92%).

Preparation of IC-3

A solution of DBU (8.46 g, 55.6 mMol) in 50 ml of dichloromethane was added in drops over a period of 1 h to a mixture of compounds 1 (9.66 g, 27.8 mMol) and 5 (19.07 g, 27.8 mmol) in 150 ml of dichloromethane that was stirred at 5° C. Following the addition, the mixture was stirred at 5° C. for 1 h and at room temperature for 20 h, giving a deep-brown solution. The solvent was distilled off, the residue dissolved in 500 ml of ethyl acetate and acidified slowly with 25 ml of concentrated hydrochloric acid. The mixture was stirred at room temperature for 2 h and poured into 400 ml of saturated aqueous sodium bicarbonate. The layers were separated and the aqueous one extracted with 100 ml of ethyl acetate. The combined organic solutions were washed with brine (2×300 ml), dried over magnesium sulfate and concentrated to give an oil. The crude product was purified by column chromatography (silica gel, ethyl acetate/hexanes) giving a solid that was further purified by boiling with ethanol (200 ml). Upon cooling to room temperature the solid was filtered off, washed with ethanol (2×10 ml) and dried in vacuo for 20 h. The yield of IC-3 was 13.62 g (14.5 mMol, 52%), m.p. 123–125° C.; ESMS: ES+, m/z 940 (M+1, 20 base); ES−, m/z 938 (M−1, base).

Preparation of IC-12:

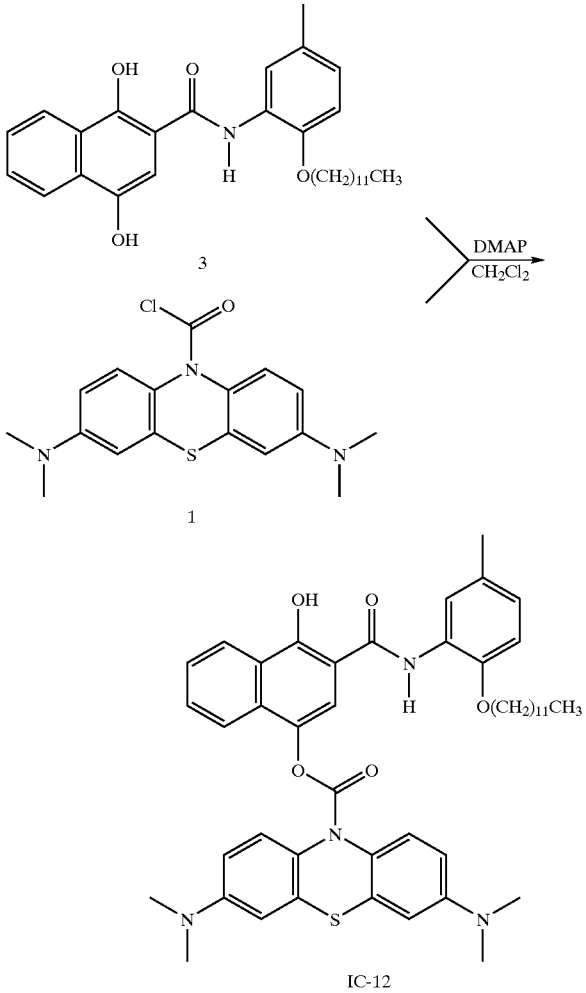

Solid DMAP (0.24 g, 2 mMol) was added at 5° C. to a mixture of compounds 1 (0.35 g, 1 mMol) and 3 (0.48 g, 1 mMol) in 5 ml of dichloromethane. Next, the resulting solution was kept at room temperature for 2 h and filtered through silica gel, giving an oil. Stirring with 10 ml of methanol for 5 days produced a solid which was collected, washed with 2×2 ml of methanol and dried in vacuo for 2 h. The yield of IC-12 was 0.30 g (0.38 mMol, 38%); ESMS: ES+, m/z 789 (M+1, base).

Photographic Examples

Processing conditions are as described in the examples. Unless otherwise stated, the silver halide was removed after development by immersion in Kodak Flexicolor Fix solution. In general, an increase of approximately 0.2 in the measured density would be obtained by omission of this step.

Example 1

Coating examples were prepared on a 7 mil thick poly (ethylene terephthalate) support and comprised an emulsion containing layer (contents shown below) having the components of Table 1 with an overcoat layer of gelatin (0.22 g/m$^2$) and 1,1'-(methylenebis(sulfonyl))bis-ethene hardener (at 2% of the total gelatin concentration). Both layers contained spreading aids to facilitate coating.

TABLE 1

| Component | Laydown |
|---|---|
| Silver (from emulsion E-1) | 0.54 g/m$^2$ |
| Silver (from silver salt SS-1) | 0.32 g/m$^2$ |
| Silver (from silver salt SS-2) | 0.32 g/m$^2$ |
| Coupler | * |
| Developer Dev-1 | 0.86 g/m$^2$ |
| Salicylanilide | 0.86 g/m$^2$ |
| Lime-processed gelatin | 4.3 g/m$^2$ |

*Comparison conventional coupler CC-1 was coated at 0.72 mM/m$^2$; Inventive dye releasing coupler IC-1 was coated at the same molar level.

Common Components

Silver salt Dispersion SS-1

A stirred reaction vessel was charged with 431 g of lime-processed gelatin and 6569 g of distilled water. A solution containing 214 g of benzotriazole, 2150 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 L solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Silver salt Dispersion SS-2

A stirred reaction vessel was charged with 431 g of lime-processed gelatin and 6569 g of distilled water. A solution containing 320 g of 1-phenyl-5-mercaptotetrazole, 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 L solution of 0.54 molar silver nitrate was added to the kettle at 250 cc/minute, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Emulsion

The silver halide emulsion E1 was prepared by conventional means to have a tabular morphology with composition of 98% silver bromide and 2% silver iodide and an equivalent circular diameter of 0.42 microns and a thickness of 0.06 microns The emulsion was spectrally sensitized to blue light by addition of sensitizing dyes and then chemically sensitized for optimum performance.

Coupler Dispersions

An oil-based, coupler dispersion of IC-1 was prepared containing the appropriate dye releasing coupler, di-n-butyl phthalate and ethyl acetate in the ratio of 1:1:3 by weight. To this oil phase was added a solution of gelatin and surfactant in water and the mixture was milled repeatedly to give a final coupler dispersion that was 3% by weight coupler and 6% by weight gelatin. The comparison, conventional coupler CC-1 was dispersed using di-n-butyl sebacate in the ratio of 1 part coupler to 1 part solvent by weight. 2-(2-Butoxyethoxy) ethyl acetate was used as an auxiliary solvent, and was subsequently removed by aqueous washing, to give a final composition that was 8% coupler, 9.14% gelatin.

CC-1

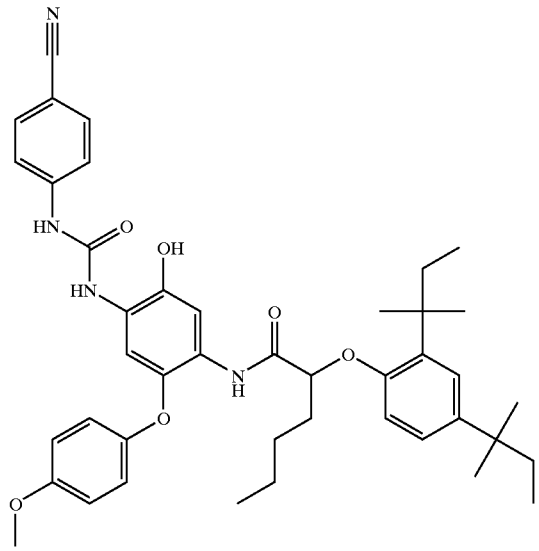

IC-1

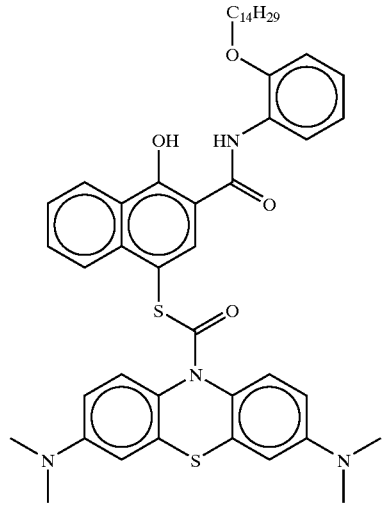

Incorporated Developer (Dev-1):

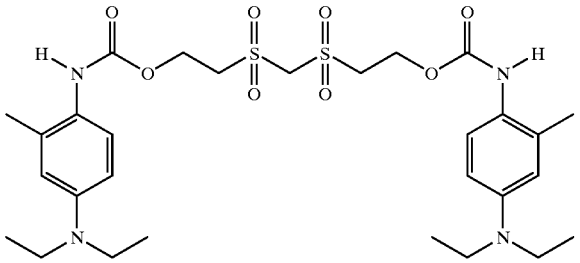

This material was ball-milled in an aqueous mixture, for 4 days using zirconia beads in the following formula. For 1 g of Incorporated developer, sodium triisopropylnaphthalene sulfonate (0.1 g), water (to 10 g), and beads (25 ml), were used. In some cases, after milling, the slurry was diluted with warmed (40° C.) gelatin solution (12.5%, 10 g) before the beads were removed by filtration. The filtrate (with or without gelatin addition) was stored in a refrigerator prior to use.

Salicylanilide

A dispersion of salicylanilide was prepared by the method of ball milling. To a total 20 g sample was added 3.0 gm salicylanilide solid, 0.20 g polyvinyl pyrrolidone, 0.20 g Triton X 200 surfactant, 1.0 g gelatin, 15.6 g distilled water, and 20 mL of zirconia beads. The slurry was ball milled for 48 hours. Following milling, the zirconia beads were removed by filtration. The slurry was reftigerated prior to use. For preparations on a larger scale, the salicylanilide was media—milled to give a final dispersion containing 30% Salicylanilide, with 4% Triton X 200 surfactant and 4% polyvinyl pyrrolidone added relative to the weight of Salicylanilide. In some cases the dispersion was diluted with water to 25% Salicylanilide or gelatin (5% of total) was added and the concentration of Salicylanilide adjusted to 25%. Biocide may also be added.

Coating Evaluation

The resulting coatings were exposed through a step wedge to a 3.04 log lux light source at 3000K filtered by Daylight 5A, and Wratten 2B filter. The exposure time was 0.5 seconds. After exposure, the coating was thermally processed by contact with a heated platen for 20 seconds. A number of strips were processed at a variety of platen temperatures in order to check the generality of the effects that were seen. Data is presented here for processing at 150° C. From the data collected, photographic parameters were obtained:

Drange: the density difference between maximum and minimum densities formed by development. Drange=(Dmax−Dmin).

Gamma: from the Characteristic curve, the maximum 2 point contrast between any two measured density steps which are separated by one intervening step.

These parameters provide useful measures to compare coupler performance, by dye forming ability and rate of dye density formation with exposure, which measures are shown in Table 2 below.

TABLE 2

| Coupler | | Drange | % of CC-1 | Gamma | % of CC-1 |
|---|---|---|---|---|---|
| CC-1 | Comparison | 0.65 | 100 | 0.51 | 100 |
| IC-1 | Inventive | 1.50 | 231 | 1.36 | 267 |

As evident from these results in Table 2 above, the inventive coupler formed more than twice the dye density of the comparison.

EXAMPLE 2

This set of coatings was prepared to have similar components and format to Example 1 with the exceptions that comparison coupler CC-1 was coated at 0.9 mM/m$^2$ from a dispersion in di-n-butyl phthalate; coupler IC-2 (below)

replaced coupler IC-1 and was coated at 0.22 mM/m$^2$, that is, one quarter of the comparison coupler concentration.

IC-2

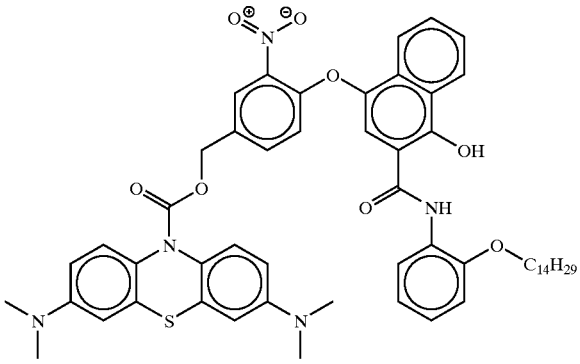

The emulsion used was E-2, coated at 0.86 g/m$^2$. It was sensitized to green light, and was a tabular emulsion with composition of 96% silver bromide and 4% silver iodide. It had an equivalent circular diameter of 1.2 microns and a thickness of 0.12 microns. The resulting coatings were exposed through a step wedge to a 3.04 log lux light source at 3000K filtered by Daylight 5A and Wratten 9 filters. The exposure time was 0.01 second. Strips were processed using a heated drum processor and optimum conditions were 161° C. for 18 seconds.

From the data collected the photographic parameters (defined above) in Table 3 below were obtained.

TABLE 3

| Coupler | | Drange | % of CC-1 | Gamma | % of CC-1 |
|---|---|---|---|---|---|
| CC-1 | Comparison | 0.39 | 100 | 0.29 | 100 |
| IC-2 | Inventive | 0.42 | 108 | 0.39 | 134 |

The inventive coupler formed more dye density even though it was coated at a level, one fourth that of the comparison coupler.

Example 3

The inventive coatings having the coating format shown below were prepared on a 7 mil thick poly(ethylene terephthalate) support and comprised an emulsion containing layer (contents shown below) with an overcoat layer of gelatin (3.2 g/m$^2$) and 1,1'-(methylenebis(sulfonyl))bisethene hardener (at 2% of the total gelatin concentration). Both layers contained spreading aids to facilitate coating.

| Component | Laydown |
|---|---|
| Silver (from emulsion E-2) | 0.86 g/m$^2$ |
| Silver (from silver salt SS-1) | 0.32 g/m$^2$ |
| Silver (from silver salt SS-2) | 0.32 g/m$^2$ |
| Coupler | 0.67 mMol/m$^2$ |
| Developer Dev-1 | 0.86 g/m$^2$ |

-continued

| Component | Laydown |
|---|---|
| Salicylanilide | 0.86 g/m$^2$ |
| Lime-processed gelatin | 4.3 g/m$^2$ |

CC-2

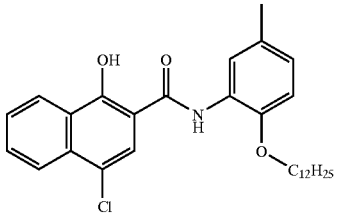

CC-3

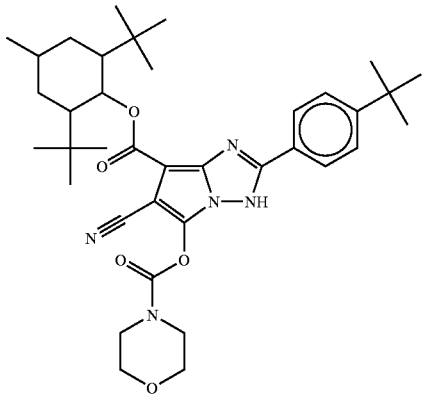

This set of coatings was prepared as described in the format above. The comparison couplers CC-2 and CC-3 were also coated at 0.67 mM/m$^2$ from dispersions in di-n-butyl phthalate. The emulsion used was E-2, coated at 0.86g/m$^2$ as described in Example 2. The resulting coatings were exposed through a step wedge to a 3.04 log lux light source at 3000K filtered by Daylight 5A and Wratten 9 filters. The exposure time was 0.1 second.

Strips were processed using a heated drum processor and optimum conditions were 151° C. for 18 seconds.

| | Drange | % of CC-2 | Gamma | % of CC-2 |
|---|---|---|---|---|
| IC-12 | 1.45 | 500 | 1.02 | 567 |
| CC-2 | 0.29 | 100 | 0.18 | 100 |
| CC-3 | 0.41 | 141 | 0.29 | 161 |

The inventive coupler formed considerably more dye density than the comparison coupler CC-2, which has the same coupler parent but without the released high extinction dye fragment. The inventive coupler also performed considerably better than coupler CC-3 which has been shown in this system to be a very good performing coupler due to the high extinction dye that is formed upon reaction with oxidized developer.

What is claimed is:

1. A photographic element containing a light-sensitive silver-halide emulsion layer having associated therewith a coupler represented by Formula I:

$$\text{COUP-(T)}_m\text{—L-DYE'} \quad \text{(I)}$$

wherein

COUP is a photographic coupler residue capable of coupling with oxidized color developer to form a first cyan dye;

T is a timing group;

m is an integer from 0 to 2;

L is a linking group selected from the group consisting of —OC(=O)—, —OC(=S)—, —SC(=O)—, and —SC(=S)—, wherein T, when m is not 0, or L, when m is 0, is attached to the coupling site of COUP; and DYE' is group that, upon release from the coupling site, forms a second dye, or dye precursor that is converted to a second dye, which second dye is also cyan colored, which DYE' group is represented by the following formula:

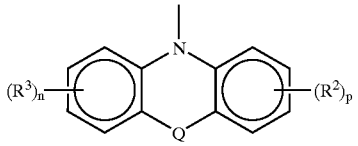

wherein $R^2$ and $R^3$ are independently organic or inorganic substituents, or a plurality of $R^2$ and/or a plurality of $R^3$ groups can form a saturated, unsaturated, or aromatic carbocyclic or heterocylic ring, the $R^2$ and $R^3$ substituents, and any rings formed thereby, being selected so that the second dye absorbs light predominantly in the range of 600 to 700 nm;

n and p are independently an integer from 0 to 4; and

Q is O, S, or NR' where R' is H or a substituted or unsubstituted alkyl or aryl group.

2. The photographic element of claim 1 wherein DYE' is a releasable group that, after release, forms a compound $HNR^5R^4$ wherein $R^5$ and $R^4$ are interconnected to form, together with nitrogen atom to which it is connected, a heterocyclic ring selected from the group of phenothiazine, phenoxazine, and phenazine, or derivatives thereof.

3. The photographic element of claim 1 wherein the coupler is represented by the following formula:

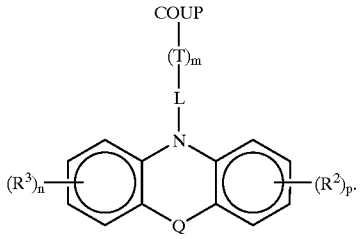

4. The photographic element of claim 1 in which DYE' is represented by the following structure:

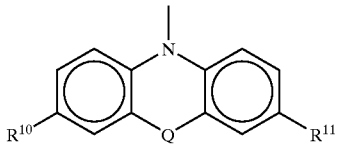

wherein each $R^{10}$ and $R^{11}$ of the above formula individually is a group capable of donating electrons.

5. The photographic element of claim 4 in which each $R^{10}$ and $R^{11}$ is selected from the group of $SR^{12}$, $OR^{13}$, and $NR^{14}R^{15}$ wherein each $R^{12}$, $R^{13}$, and $R^{14}$ is individually hydrogen or an alkyl group generally containing 1 to 8 carbon atoms, and each $R^{15}$ is an alkyl group usually containing 1 to 8 carbon atoms.

6. The photographic element of claim 4 in which $R^{10}$ and $R^{11}$ groups are selected from the group consisting of OH, $N(CH_3)_2$, $N(C_2H_5)_2$, and $NHCH_3$.

7. The photographic element of claim 5 in which DYE' is represented by the following formula:

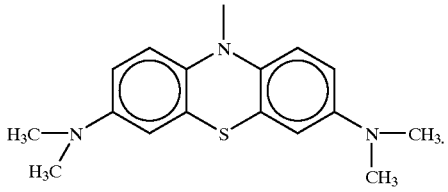

8. The photographic element of claim 1 wherein COUP is a phenol or naphthol coupler which forms a cyan dye on reaction with oxidized color developing agent.

9. The photographic element of claim 1 wherein couplers are cyan-forming couplers of the following structure:

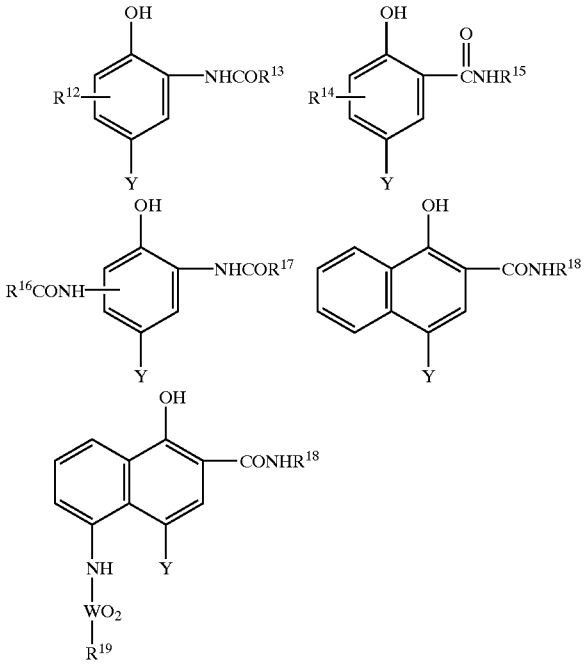

wherein Y is the —(T)m —L-DYE' unit attached to the coupling site; $R^{13}$, $R^{15}$, $R^{16}$, $R^{17}$ and $R^{18}$ represent ballast groups, and $R^{12}$, and $R^{14}$ represent one or more halogen, lower alkyl, lower alkoxy groups, or ballast groups; W is either C or S, $R^{19}$ is an alkyl or alkoxy group and j is 1, when W is C, or 2 when W is S.

10. The photographic element of claim 1 comprising at least three light-sensitive units which have their individual sensitivities in different wavelength regions, each of the units comprising at least one light-sensitive silver-halide emulsion, binder, dye-providing coupler, and blocked developer.

11. The photographic element of claim 1, wherein the element comprises a red-light-sensitive-layer unit, a green-light-sensitive layer unit and a blue-light-sensitive layer unit, wherein at least one layer unit has in reactive association a blocked developer in association with the dye forming coupler of claim 1.

12. The photographic element of claim 1, wherein the element is a photothermographic element such that the imagewise exposed element is capable of being developed by heat treatment.

13. The photographic element according to claim 12 wherein the silver-halide emulsion layer of the photothermographic element further comprises a blocked developer and a non-light sensitive silver salt oxidizing agent.

14. A photographic element according to claim 13 that is capable of dry development without the application of aqueous solutions.

15. A photographic element containing a light-sensitive silver-halide emulsion layer having associated therewith a coupler represented by the following formula:

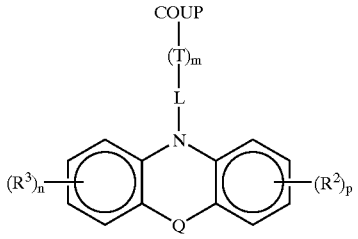

wherein

COUP is a coupler parent group capable of reacting with an oxidized developer to form a first cyan dye;

T is a timing group;

m is an integer from 0 to 2;

L is a linking group selected from the group consisting of —OC(=O)—, —OC(=S)—, —SC(=O)—, and —SC(=S)— wherein T, when m is not 0, or L, when m is 0, is attached to the coupling site of COUP;

$R^2$ and $R^3$ are independently selected from the group consisting of substituted or unsubstituted alkyl, aryl, alkoxy, hydroxy, amino, alkylamino, dialkylamino, and acetamido groups having 1 to 10 carbon atoms, and wherein a plurality of $R^2$ and $R^3$ groups can form a saturated, unsaturated, or aromatic carbocyclic or heterocyclic ring;

n and p are independently an integer from 1 to 4; and

Q is O, S, or NR' where R' is H or a substituted or unsubstituted alkyl or aryl group.

16. The photographic element of claim 15 wherein the coupler is represented by the following formula:

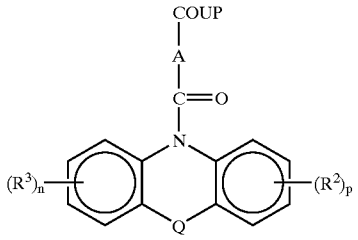

wherein A is O or S and Q, $R^2$, $R^3$, n, and p are as previously defined.

17. A method of image formation comprising the step of developing an imagewise exposed photographic element comprising at least three light-sensitive units which have their individual sensitivities in different wavelength regions, each of the units comprising at least one light-sensitive silver-halide emulsion, binder, and dye-providing coupler, which coupler is represented by the following formula:

$$\text{COUP-(T)}_m\text{—L-DYE'} \quad \text{(I)}$$

wherein

COUP is a photographic coupler residue capable of coupling with oxidized color developer to form a first cyan dye;

T is a timing group;

m is an integer from 0 to 2;

L is a linking group selected from the group consisting of —OC(=O)—, —OC(=S)—, —SC(=O)—, and —SC(=S)— wherein T, when m is not 0, or L, when m is 0, is attached to the coupling site of COUP; and wherein DYE' is a releasable group that upon release forms a second dye, or dye precursor that is converted to a second dye, which second dye also exhibits a cyan color, wherein DYE' is represented by the following formula:

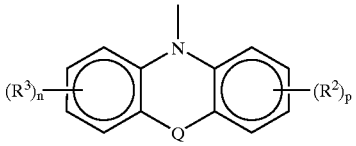

wherein $R^2$ and $R^3$ are independently selected organic or inorganic substituents, and wherein a plurality of $R_2$ and $R_3$ groups can form a saturated, unsaturated, or aromatic heterocyclic or carbocyclic ring;

n and p are independently an integer from 0 to 4; and

Q is O, S, or NR' where R' is H or a substituted or unsubstituted alkyl or aryl group.

18. A method according to claim 17, wherein the element is a photothermographic element that further comprises a blocked developer and said step of developing comprises treating said imagewise exposed element at a temperature between about 80° C. and about 180° C. for a time ranging from about 0.5 to about 60 seconds.

19. A method according to claim 17, wherein the developing comprises treating said imagewise exposed element to a volume of processing solution that is less than 1 times the volume of solution required to fully swell the photographic element.

20. A method according to claim 19, wherein the developing is accompanied by the application of a laminate sheet containing additional processing chemicals.

21. A method according to claim 17 wherein image formation comprises the step of scanning an imagewise exposed and developed imaging element to form a first electronic image representation of said imagewise exposure.

22. A method according to claim 17 wherein the image formation comprises the step of digitizing a first electronic image representation formed from an imagewise exposed, developed, and scanned imaging element to form a digital image.

23. A method according to claim 17 wherein image formation comprising the step of modifying a first electronic image representation formed from an imagewise exposed, developed, and scanned imaging element formulated to form a second electronic image representation.

24. A method according to claim 17 comprising storing, transmitting, printing, or displaying an electronic image representation of an image derived from an imagewise exposed, developed, and scanned imaging element.

25. A method according to claim 24, wherein printing the image is accomplished with any of the following printing technologies: electrophotography; inkjet; thermal dye sublimation; or CRT or LED printing to sensitized photographic paper.

26. A method according to claim 17 wherein the developing is accomplished in a dry state without the application of aqueous solutions.

* * * * *